US008172556B2

(12) United States Patent
Malec et al.

(10) Patent No.: US 8,172,556 B2
(45) Date of Patent: May 8, 2012

(54) DEVICE FOR SUPPLYING FUEL

(75) Inventors: Radek Malec, Ceske Budejovice (CZ); Vladimir Ptacek, Modrany (CZ); Martin Ptacek, Ceske Budejobice (CZ); Martin Sykora, Ceske Budejovice (CZ); Josef Jarosik, Ceske Budejovice (CZ); Miloslav Gabris, Ceske Budejovice (CZ)

(73) Assignee: Robert Bosch GmbH, Stuttgart (DE)

( * ) Notice: Subject to any disclaimer, the term of this patent is extended or adjusted under 35 U.S.C. 154(b) by 457 days.

(21) Appl. No.: 12/447,316

(22) PCT Filed: Oct. 17, 2007

(86) PCT No.: PCT/EP2007/061053

§ 371 (c)(1),
(2), (4) Date: Apr. 27, 2009

(87) PCT Pub. No.: WO2008/049762

PCT Pub. Date: May 2, 2008

(65) Prior Publication Data

US 2010/0119387 A1 May 13, 2010

(30) Foreign Application Priority Data

Oct. 27, 2006 (DE) ..... 10 2006 050 818

(51) Int. Cl.
*F04B 35/04* (2006.01)

(52) U.S. Cl. ..... 417/423.15; 123/509; 123/510

(58) Field of Classification Search ..... 417/423.15; 123/509, 510

See application file for complete search history.

(56) References Cited

U.S. PATENT DOCUMENTS

| | | | |
|---|---|---|---|
| 6,142,126 | A | 11/2000 | Kanamaru |
| 2003/0084884 | A1 | 5/2003 | Sawert et al. |
| 2003/0101971 | A1 | 6/2003 | Farrar et al. |

FOREIGN PATENT DOCUMENTS

| | | | |
|---|---|---|---|
| EP | 0965747 | A1 | 12/1999 |

*Primary Examiner* — Joseph L Williams
(74) *Attorney, Agent, or Firm* — Ronald E. Greigg

(57) ABSTRACT

Devices for supplying fuel are already known, having a supply unit which has a pump housing connected to an electrical ground and is supported on a pump mount. It is disadvantageous that during operation, the pump mount can become electrostatically charged and has no device for electrostatic discharging during operation.

The invention provides an especially simple and economical grounding device for the pump mount. In particular, a charge diverter is connected to the pump housing via a grounding element, and contacts a surface of the pump mount.

7 Claims, 2 Drawing Sheets

DEVICE FOR SUPPLYING FUEL

CROSS-REFERENCE TO RELATED APPLICATION

This application is a 35 USC 371 application of PCT/EP 2007/061053 filed on Oct. 17, 2007.

BACKGROUND OF THE INVENTION

1. Field of the Invention

The invention is based on a device for supplying fuel.

2. Description of the Prior Art

A device for supplying fuel is already known, having a supply unit which has a pump housing connected to an electrical ground and is supported on a pump mount. It is disadvantageous that during operation, the pump mount can become electrostatically charged and has no device for electrostatic discharging during operation.

ADVANTAGES AND SUMMARY OF THE INVENTION

The device according to the invention has the advantage over the prior art that an electrostatic discharge of the pump mount takes place during operation, in that a charge diverter rests on a surface of the pump mount and is connected to the pump housing via a grounding element.

It is especially advantageous that the charge diverter is made from brass, copper or steel, since these materials are electrically conductive and thus divert the electrostatic charges.

It is also advantageous if the grounding element is attached to the pump mount by at least two retaining arms and with at least one first spring arm contacts the charge diverter and with at least one second spring arm contacts the pump housing. This embodiment is especially economical to make from a sheet-metal strip and is especially easy to assemble by machine. Grounding the pump mount does not require any expensive and complicated welded or soldered connections.

In an advantageous embodiment, the retaining arms of the grounding element are angled relative to the center rib, in order with the retaining arms to form an insertable clamp. The spring arms are likewise angled relative to the center rib, so that they can press resiliently against the respective contact partner.

It is highly advantageous if the spring arms are rounded on their ends toward the contact, since in this way a good electrical contact is obtained.

It is also advantageous if the retaining arms are embodied with sharp edges on their ends remote from the center rib, since in this way an especially firm clamp action of the grounding element on the pump mount is obtained, so that the grounding element is especially well fixed and cannot come loose or be shifted by vibration.

BRIEF DESCRIPTION OF THE DRAWINGS

One exemplary embodiment of the invention is described in further detail in the ensuing description in conjunction with the drawings, in which.

DESCRIPTION OF THE PREFERRED EMBODIMENT

Figure 1:
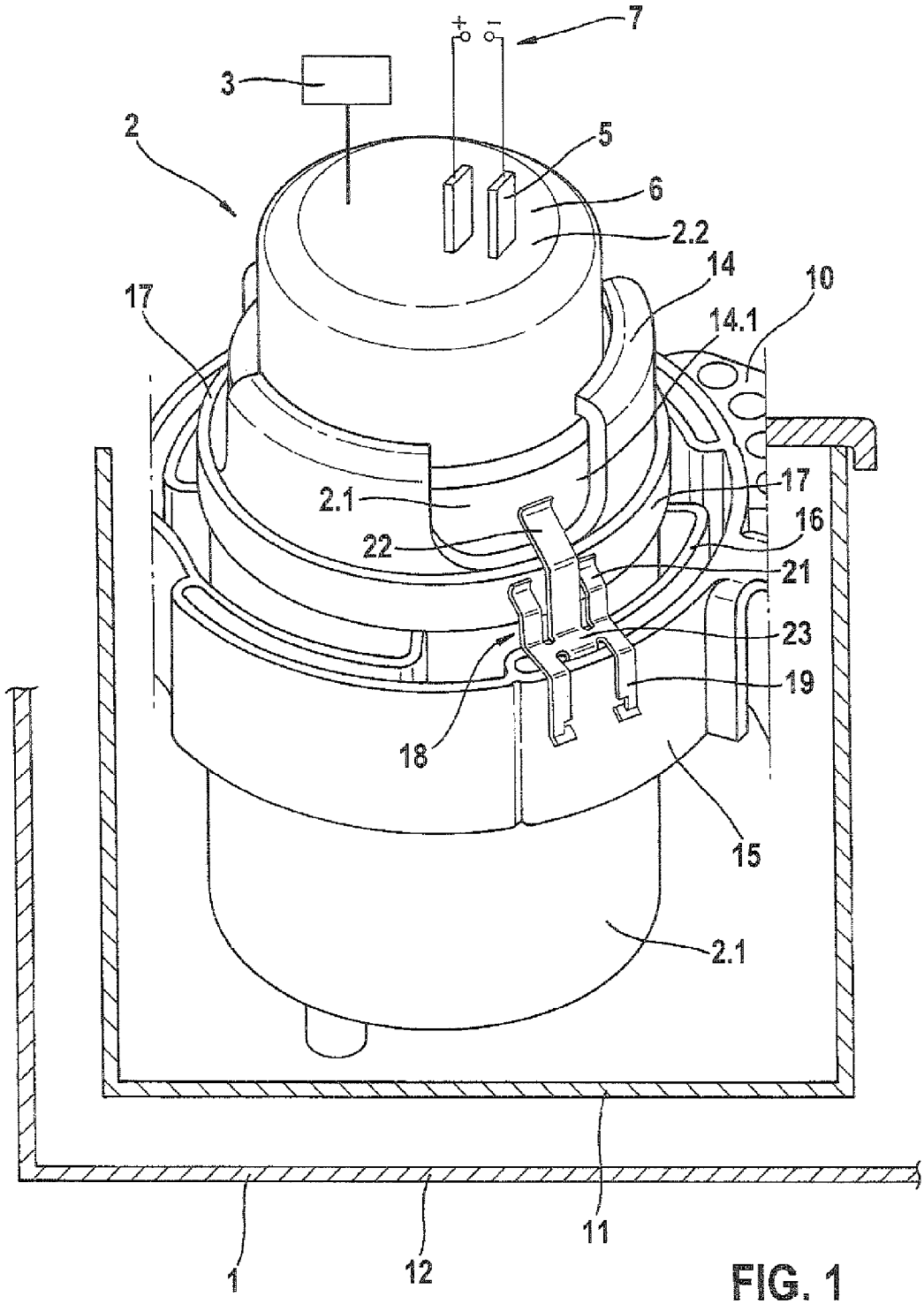
FIG. 1 shows a three-dimensional view of the device for supplying fuel.

FIG. 1 shows a three-dimensional view of the device for supplying fuel in simplified form.

The device is disposed in a reservoir 1, such as a fuel tank and has a supply unit 2, which supplies fuel from the reservoir 1 to an internal combustion engine 3.

The supply unit is an arbitrary pump, such as a flow pump or a positive displacement pump.

The supply unit 2 has a cylindrical metal pump housing 2.1, which is electrically conductively connected to an electrical ground 6 and in this way is grounded. The electrical ground 6 is for instance the body of the vehicle. The pump housing 2.1 is closed at its face end by a connection cap 2.2, on which in this instance two connection plugs 5 are provided for making contact with a voltage source 7.

The supply unit 2 is supported on a pump mount 10, which is secured to the reservoir 1 or, in the exemplary embodiment, to a storage container 11 on the reservoir 1. The storage container 11 keeps enough fuel on hand that even if the fuel sloshes back and forth in the reservoir 1, fuel can still be aspirated and supplied. The storage container 11 is provided on a bottom 12 of the reservoir 1.

The pump mount 10 damps vibration originating at the supply unit 2, so that as little structure-borne sound as possible is transmitted to the reservoir 1. In the exemplary embodiment, this is attained by means of two retaining rings 14, 15, disposed concentrically to one another, which are mechanically connected to one another by means of elastic elements 16. The supply unit 2 is secured to the inner retaining ring 14, and the outer retaining ring 15 is for instance secured to the storage container 11. The elastic elements 16 are connected for instance integrally to the two retaining rings 14, 15 and extend over a predetermined length in the circumferential direction relative to the retaining rings 14, 15. The pump mount 10 is made from plastic, for instance.

The electrostatic charges that accumulate at the pump mount 10 have to be diverted, for the sake of fire prevention.

According to the invention, it is therefore provided that a charge diverter 17, which is connected to the pump housing 2.1 via a grounding element 18, contacts a surface of the pump mount 10.

The charge diverter 17 in the exemplary embodiment is embodied annularly and surrounds the inner retaining ring 14. However, it can expressly have any other shape as well. For instance, the charge diverter 17 is press-fitted onto the inner retaining ring 14 and prevents swelling of the inner retaining ring 14. The charge diverter 17 is made from metal, such as brass, copper, or steel.

According to the invention, the grounding element 18 is slipped onto the pump mount 10, for instance onto the outer retaining ring 15. For that purpose, the grounding element 18 has at least two resilient retaining arms 19, which project over or clamp the outer retaining ring 15 and retain the grounding element 18 on the pump mount 10 with a predetermined spring force. For instance, three retaining arms 19, disposed side by side and spaced apart from one another, are provided, and the two outer retaining arms 19 contact the outer circumference, and the middle retaining arm 19 contacts the inner circumference, of the outer retaining ring 15. The retaining arms 19 are angled such that the retaining arm 19 provided on the inner circumference is spaced apart from the other retaining arms 19 by approximately the thickness of the outer retaining ring 15.

The grounding element 18 has at least one first spring arm 21 and at least one second spring 22 arm; the first spring arm

21 contacts the charge diverter 17, and the second spring arm 22 contacts the pump housing 2.1. For instance, two first spring arms 21 and one second spring arm 22 are provided, and the one second spring aim 22 is disposed between the two first spring arms 21. The three spring arms 21, 22 are spaced apart from one another. The spring arms 21, 22 press with a predetermined spring force against their contact partner of the pump housing 2.1, and the charge diverter 17.

The retaining aims 19 and the spring arms 21, 22 are joined together via a center rib 23. The spring arms 21, 22 are disposed on one long side, and the retaining arms 19 on the opposite long side, of the center rib 23 and extend transversely to its length.

The inner retaining ring 14 has in this instance one cutout 14.1, through which the second spring arm 22 contacts the pump housing 2.1.

Figure 2:
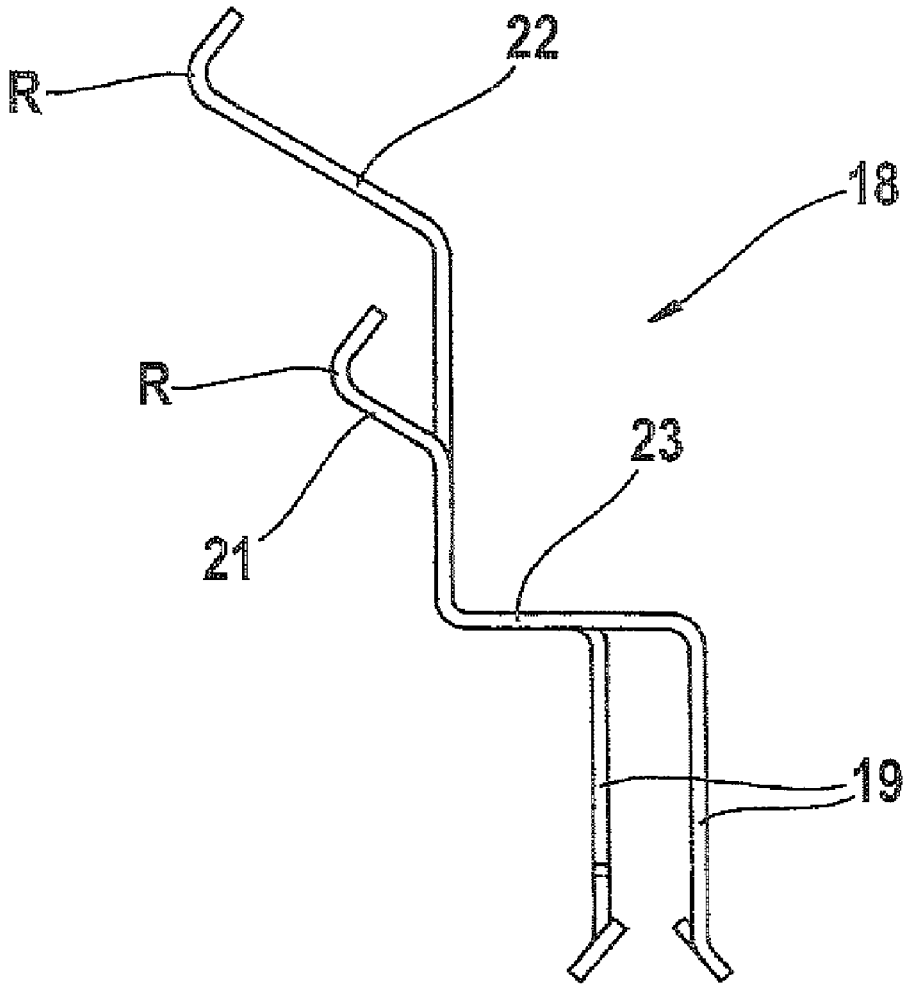
FIG. 2 shows a grounding element according to the invention.

FIG. 2 shows a grounding element according to the invention as in the device of FIG. 1.

In the grounding element of FIG. 2, those parts that remain the same or function the same as in the device of FIG. 1 are identified by the same reference numerals.

The grounding element 18 of the invention is made from a sheet-metal strip, for instance of spring steel. The retaining arms 19 and the spring arms 21, 22 are angled by approximately 90°, for instance, relative to the center rib 23, so that the retaining arms 19, center rib 23 and spring arms 21, 22 form a step shape. The spring arms 21, 22 are angled one more time on their ends toward the contact partner of the pump housing 2.1, and the charge diverter 17 for the sake of making contact and are rounded directly at the contact point, for instance by means of a bending radius R.

The retaining arms 19 are embodied with sharp edges on their ends remote from the center rib 23, so that the grounding element 18 is connected especially solidly to the pump mount 10. For instance, the retaining arms 19 are bent over with sharp edges on those ends.

The foregoing relates to the preferred exemplary embodiment of the invention, it being understood that other variants and embodiments thereof are possible within the spirit and scope of the invention, the latter being defined by the appended claims.

The invention claimed is:

1. A device for supplying fuel, comprising:

a supply unit having a pump housing;

an electrical ground connected to the pump housing;

a pump mount supporting the supply unit;

a charge diverter;

a grounding element connecting the charge diverter to the pump housing, wherein the charge diverter contacts a surface of the pump mount, and the grounding element is attached to the pump mount by at least two retaining arms and at least one first spring arm contacts the charge diverter and at least one second spring arm contacts the pump housing, and wherein the grounding element has a center rib, and the spring arms are disposed on one side of the center rib, and the retaining arms are disposed on an opposite side of the center rib.

2. The device as defined by claim 1, wherein the charge diverter is embodied annularly.

3. The device as defined by claim 1, wherein the charge diverter is made from brass, copper or steel.

4. The device as defined by claim 1, wherein the grounding element is made from sheet metal.

5. The device as defined by claim 1, wherein the spring arms and the retaining arms are angled relative to the center rib.

6. The device as defined by claim 1, wherein the spring arms are rounded on their ends oriented toward their respective contacts of the charge diverter and the pump housing.

7. The device as defined by claim 1, wherein the retaining arms are embodied as sharp-edged on their ends remote from the center rib.

* * * * *